United States Patent [19]

Hults et al.

[11] 4,074,100

[45] Feb. 14, 1978

[54] ELASTIC TOGGLE SWITCH LEVER MOUNTING

[75] Inventors: Harold W. Hults, New Berlin; John A. Swessel, Jr., Milwaukee, both of Wis.

[73] Assignee: Cutler-Hammer, Inc., Milwaukee, Wis.

[21] Appl. No.: 696,112

[22] Filed: June 14, 1976

[51] Int. Cl.[2] ..... H01H 3/04

[52] U.S. Cl. ..... 200/339; 200/153 G

[58] Field of Search ..... 200/335, 153 G, 293, 200/296, 302, 339; 74/520, 559

[56] References Cited

U.S. PATENT DOCUMENTS

| | | | |
|---|---|---|---|
| 2,749,400 | 6/1956 | Chichester | 200/153 G X |
| 3,087,341 | 3/1963 | Hults | 200/302 X |
| 3,146,330 | 8/1964 | Miller | 200/339 |
| 3,483,345 | 12/1969 | Hults | 200/302 |
| 3,777,087 | 12/1973 | Yeske | 200/302 X |
| 3,988,558 | 10/1976 | Josemans et al. | 200/339 X |

*Primary Examiner*—Bruce A. Reynolds
*Assistant Examiner*—David A. Tone
*Attorney, Agent, or Firm*—Hugh R. Rather; William A. Autio; Michael E. Taken

[57] ABSTRACT

An improved self-retaining type of ball and socket mounting for pivotally mounting and securing a toggle lever switch operator in the mounting bushing of an electric switch. The bushing is formed of a resilient plastic material, and has semi-spherical socket into which a complementary formed but slightly smaller pivot portion is press fitted. The socket and pivot portion of the lever are designed to constrain the lever in desired directions of oscillatory movement while preventing withdrawal through the outer end of the bushing.

1 Claim, 3 Drawing Figures

ELASTIC TOGGLE SWITCH LEVER MOUNTING

BACKGROUND OF THE INVENTION

The Miller U.S. Pat. No. 3,146,330 discloses a resilient ball and socket type mounting construction for pivotally mounting and securing a toggle lever operator in the mounting bushing of an electric switch. As there disclosed the bushing is formed of resilient plastic material and has a generally spherical interior socket into which is press fitted a slightly smaller complemental spherical intermediate pivot portion of a toggle lever. That design while providing the desired toggle oscillatory movement and constraint against withdrawal from the outer end of the bushing does not prevent rotary movement of the toggle about its longitudinal axis. Also that design depends upon proper design of the interior switch operating mechanism to constrain the toggle lever against oscillatory movements in directions other than those needed for switch operations.

OBJECTS OF THE INVENTION

It is the primary object of the present invention to provide an improved ball and socket toggle lever mounting of the aforementioned type for use in electric switches.

Another object of the invention is to provide a toggle lever mounting of the aforementioned type which is characterized by being self constrained against axial rotary movement and also against oscillatory movements in any other direction than those required for desired switch operations.

Other objects and advantages of the invention will hereinafter appear.

DESCRIPTION OF THE PREFERRED EMBODIMENT

Figure 1:
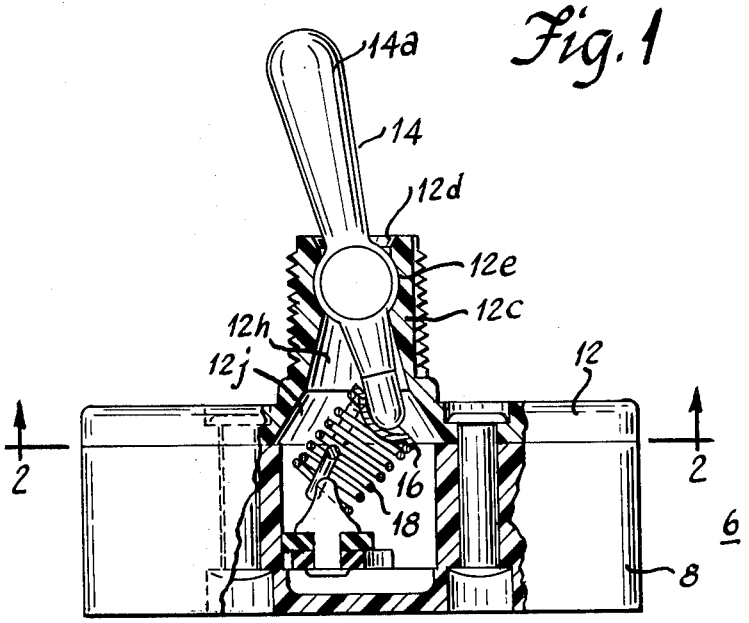
FIG. 1 is a view in side elevation of the exterior of a toggle operated electric switch embodying the invention.

Referring to the drawings the switch housing 6 includes a base 8 and a cover 12 which are preferably formed of a molded electrical insulating material. The base, and cover are held together by rivets which extend through openings 10*a* and 10*b* in the cover and aligned openings in the base and are suitably upset secured on the bottom side of the base.

The cover 12 is provided with a centrally located integrally formed bushing 12*c* which is externally threaded to receive securing nuts for mounting the same in openings in panels or the like. Bushing 12*c* is provided with aperture which extends therethrough. The upper end of the aperture has a wall 12*d* of inverted frusto conical form to accommodate to the extreme position movements of a toggle lever 14 as it is moved right and left as viewed in FIG. 1.

Figure 2:
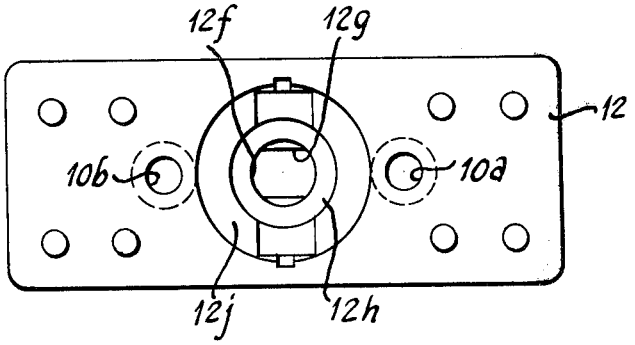
FIG. 2 is a view taken along the line 2—2 of FIG. 1 showing the interior of the switch casing cover.
Figure 3:
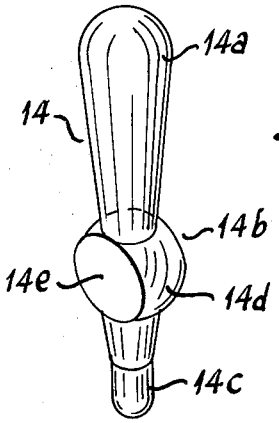
FIG. 3 is an isometric view of the toggle lever used in the switch of FIGS. 1 and 2.

Immediately below the wall 12*d* is the pivot socket 12*e* which has opposed semi-spherical walls 12*f*, FIG. 2. In the direction along the longitudinal dimension of the cover socket 12*e* has opposed parallel flat walls 12*g* which join with the semi cylindrical walls 12*f* at opposite ends thereof.

Toggle lever 14 is provided with an exterior operating handle portion 14*a*, an intermediate pivot portion 14*b*, and a lower switch operator portion 14*c*. The portion 14*b* is formed on its outer surfaces 14*d* and 14*e* to complementally match the form of the inside wall segments 12*f* and 12*g* aforedescribed in the bushing 12*c* of the cover. Lever 14 is preferably formed by molding from a suitable electrical insulating material that is somewhat resilient, but preferably less resilient than the material from which the cover 12 is formed. It is also formed so that the dimensions of the portion 14*b* is in all respects slightly smaller than the inside dimensions of complemental wall segments 12*f* and 12*g* in bushing 12*c*.

The rounded lower end of the lever portion 14*c* as shown in FIG. 1 engages in a spring guide 16 mounted in the upper end of a spring 18 in the interior operating mechanism of the switch. The interior operating mechanism which forms no part of the present invention may be assumed in one preferred form to be like that disclosed in the Meuer U.S. Pat. No. 2,077,577.

The aperture in the bushing 12*c* below the portion 12*e* has frusto-conical wall portion 12*h* which in turn merges with another frusto-conical wall portion 12*j* opening to the lower surface of cover 12. It will be appreciated that the portions 12*h* and 12*j* accommodate and provide clearance for the portion 14*c* of the toggle lever 14 as it is moved left and right as viewed in FIG. 1.

The region inside bushing 12 where the wall 12*d* intersects with the walls 12*f* and 12*g* is of an inside diameter less than the major diameter of the spherical segment part of the portion 14*b* of lever 14. Similarly, the region where the wall 12*h* intersects with the walls 12*f* and 12*g* is likewise less in diameter than such part of portion 14*b* of the lever. These regions provide constrictions against withdrawal of the portion 14*b* of the lever from the bushing socket.

To assemble lever 14 within the bushing 12*c*, the lower portion 14*c* should be inserted end first downwardly into the outer end of the aperture in bushing 12*c*. The flat side surfaces of the pivot portion 14*c* should be positioned in alignment with the corresponding complemental flat inner wall portions 12*g* of the bushing socket. When sufficient elastic deformation occurs in the region of the upper bushing constriction, the portion 14*b* will pop into place within the bushing socket and the area around the upper constriction will elastically return to its normal dimension and shape to hold the lever against movement outwardly of the bushing.

With the outer surfaces of the pivot portion being slightly smaller than the interior spacing dimensions between the opposed walls 12*f* and 12*g* of the bushing socket, lever 14 can be freely oscillated in the plane longitudinally of the switch housing to effect switch commutations The juxtaposed flat interior walls 12*g* and complemental flat surface 14*e* of the pivot portion 14*b* of the lever restrain the oscillating movement to that plane only. They also prevent rotary movement of lever 14 about its longitudinal axis within the bushing socket. The aforementioned upper and lower constriction regions in the bushing socket restrain lever 14 against withdrawal from the socket and prevent it from unwanted movement inwardly of the base 8.

We claim:

1. In an electric switch of the toggle lever type wherein a toggle lever having an enlarged intermediate pivot portion can be press fitted past a constriction in the aperture of a bushing formed of elastic material by deformation of the latter and is then seated and retained in a pivot socket in said bushing upon elastic restoration of said constriction to its former shape, the improvement comprising, providing the bushing pivot socket with spaced semi-spherical wall portions and parallel flat wall portions which merge at their opposite ends with said semi-spherical wall portions, and providing said toggle lever with a pivot portion which has surfaces that are complemental in form to and in juxtaposition with said semi-spherical and flat wall portions of said bushing pivot socket when seated therein.

* * * * *